United States Patent [19]

Debe

[11] 4,093,276

[45] June 6, 1978

[54] BIPARTITE STOCK CERTIFICATE

[76] Inventor: A. Joseph Debe, 214 Stewart Ave., Garden City, N.Y. 11530

[21] Appl. No.: 789,166

[22] Filed: Apr. 20, 1977

[51] Int. Cl.[2] ..... B42D 15/00

[52] U.S. Cl. ..... 283/1 R; 283/59

[58] Field of Search ..... 283/1 R, 59

[56] References Cited

U.S. PATENT DOCUMENTS

| | | | |
|---|---|---|---|
| 1,252,961 | 1/1918 | Smith | 283/59 |
| 1,429,423 | 9/1922 | Hamilton | 283/1 R |

*Primary Examiner*—Travis S. McGehee

*Attorney, Agent, or Firm*—Burgess, Dinklage & Sprung

[57] ABSTRACT

A stock certificate having a planar body with indicia thereon denoting the body as a single stock certificate. The body has two portions; the first corresponds to a first type of interest in the stock and has indicia thereon denoting the first type of interest; and the second corresponds to a second type of interest in the stock and has indicia thereon denoting the second type of interest. The body is capable of bipartition into separated first and second portions to enable the separated first portion to signify on its face that the holder has only the first interest in the stock, the separated second portion to signify on its face that the holder has only the second interest in the stock, and the unseparated body to signify on its face that the holder has both interests in the stock.

10 Claims, 3 Drawing Figures

BIPARTITE STOCK CERTIFICATE

BACKGROUND OF THE INVENTION

The present invention relates to a stock certificate, particularly to a stock certificate which is capable of being separated into first and second portions or components.

The present invention is part of a unique and economical service concept which separates the market value of common stocks of publicly held corporations on a basis which would permit holders to vary the emphasis between the component return and the risk elements of their common stock. This concept permits shareholders to own their common stock in a more flexible form of a unit of separable securities, each of which corresponding to a different right in the common stock.

One security can have essentially all the dividend attributes of the stock plus preferential claim to a specific amount of principal value and appreciation potential of the common stock, and the other can have residual claims to any and all other appreciation in the common stock's market value.

One form of carrying out this stock ownership plan is the unit stock investment trust which has a term of from five to ten years depending upon the particular common stock and investment requirements of the shareholders. According to the concept of the present invention, the trustee or custodian would issue to depositing shareholders, for each share of common stock deposited, a unit consisting of a PRIME (Prescribed Right to Income & Maximum Equity) component and a SCORE (Special Certificate of Residual Equity) or capital component. This concept may be applicable to many different common stocks and other variations of rights in the stocks may be utilized.

The PRIME component is a security which would embody the entire dividend attributes of the common stock as well as certain preferred stock or bond-like characteristics because of a redemption price assigned to it. Thus a holder of the PRIME component would be entitled to receive the entire dividends on a regular basis with respect to the stock, receive any subscription rights issued with respect to the stock, direct the entire vote of the common stock, and be entitled to a predetermined redemption price.

The SCORE component is a warrant-like security which has a fixed exercise price upon the termination of the trust, but unlike a conventional warrant, the holder will obtain the appreciation above the redemption price of the PRIME component in common stock of the trust without payment of the redemption price. During the life of the trust, the SCORE component is similar to a warrant whose exercise price is variable; i.e., its effective exercise price to acquire a share of stock from the trust is the cost of purchasing a PRIME component which under most circumstances would be less than the redemption price of the PRIME component.

SUMMARY

The present invention provides a stock certificate having a body having a first portion corresponding to the PRIME component and having a second portion corresponding to the SCORE component and means for effecting bipartition of the body into separated first and second portions, whereby the separated first portion signifies on its face that the holder has only the PRIME right in the stock, the separated second portion signifies on its face that the holder has only the SCORE right in the stock and the unseparated body signifies on its face that the holder has both the SCORE and the PRIME rights in the stock.

The integral stock certificate can be divided along a perforation line, indentation line or cutting line for effecting separation thereof from one unit into PRIME and SCORE components.

The stock certificate of the present invention includes a planar body having indicia thereon denoting it as a trust unit and which consists of a PRIME component and a detachable SCORE component which are issued to a depositor of common stock.

Each PRIME certificate would have the same ultimate redemption price irrespective of date issued so as to make them readily transferable and marketable. The SCORE component also has a market price during the life of the trust which reflects any appreciation in the price of a common stock not claimed by the PRIME component and thus the SCORE component represents a highly leveraged security with the costs of obtaining such leverage being insignificant relative to the alternatives available at the present time such as by marketable call options or conventional warrants.

DESCRIPTION

The stock certificate has a planar body 1 which is preferably made out of high grade paper but which may also be made of any suitable material used for stock certificates or securities.

Figure 1:
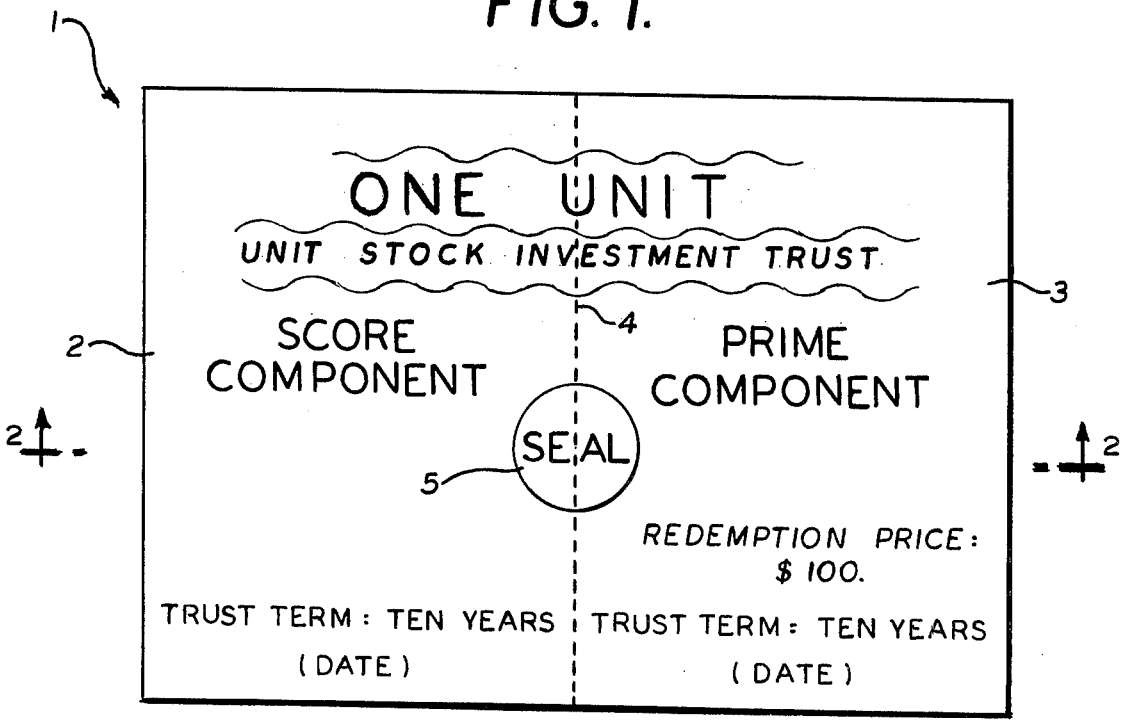
FIG. 1 is a front view of the stock certificate of the present invention.
Figure 2:
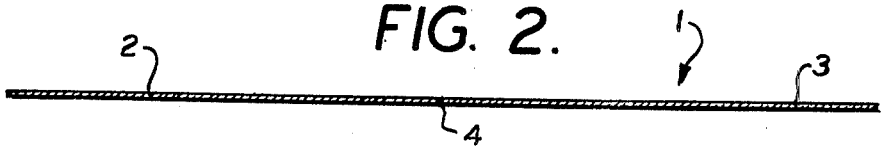
FIG. 2 is a cross sectional view taken along line 2—2 of FIG. 1.

The body 1 has indicia thereon denoting the body 1 as a single stock certificate. As shown in FIG. 1, this indicia includes the legend stating that it is one unit of a unit stock investment trust. This legend appears across the face of the stock certificate and over dividing line 4.

The body comprises a first portion 2 corresponding to a first type of interest in the stock and having indicia thereon denoting the first type of interest. In this embodiment, portion 2 has indicia describing the portion as a SCORE component with a trust term of ten years and the date of issuance.

Second portion 3 corresponds to a second type of interest in the stock and has indicia thereon denoting the second type of interest. In this embodiment the second type of interest is a PRIME component which has a redemption price of one hundred dollars and a trust term of ten years and bears the date of issuance.

The different interests for the single unit may vary depending upon the type of vehicle used for stock investment and the indicia on the face of each component and across the face of the body may be any suitable legend for the particular type of investment vehicle and the particular terms thereof such as the term of the trust, the redemption price and the issuance date.

Figure 3:
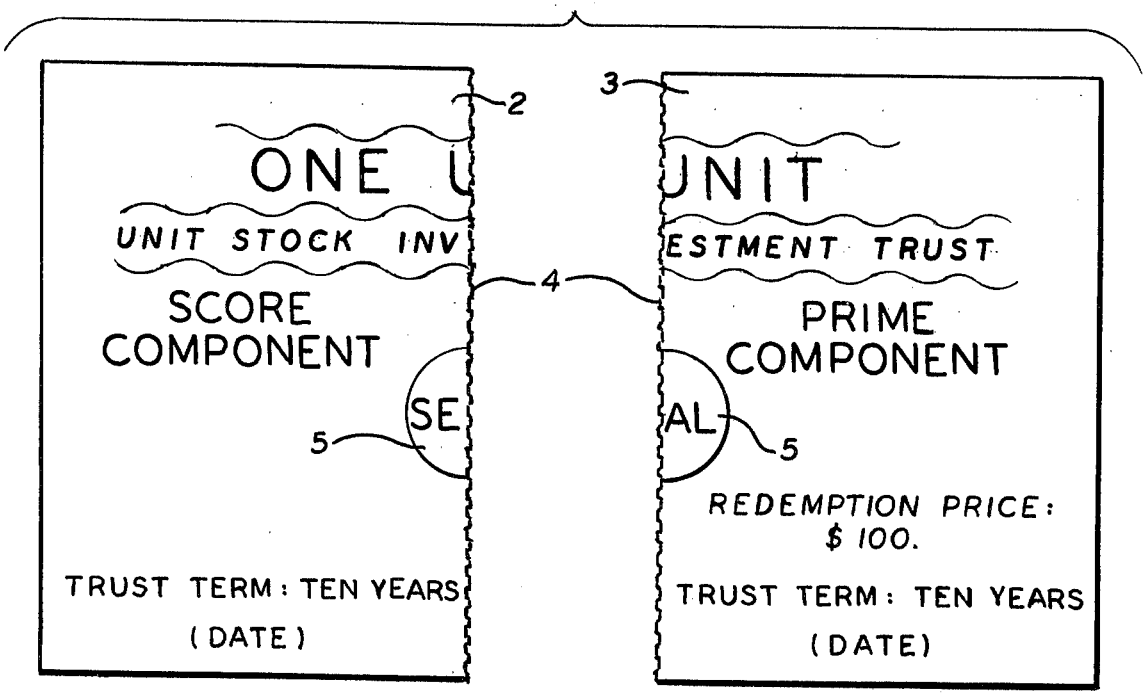
FIG. 3 is a front view of the stock certificate of FIG. 1 in its detached state.

Dividing line 4 which separates the SCORE component 2 from the PRIME component 3 also provides the means for effecting bipartition of the body 1 into separated first and second portions as shown in FIG. 3.

This means may be any suitable technique such as a perforation line, an indention line or merely a line between the two portions along which the body can be cut. In these above-mentioned cases, the body 1 is an integral unit which is separable along dividing line 4 into the two portions 2 and 3.

It is to be understood that portions 2 and 3 may be of different sizes rather than equal and may be detachably connected by other fastening means where the body portion is not originally an integral unit.

Seal 5 may be placed on the face of the body 1 and across dividing line 4 when the stock certificate is issued signifying that it is unseparated. When the stock certificate is bipartitioned such as in FIG. 3, the seal is also partitioned signifying that the interests in the stock unit have been divided.

When the stock certificate is in a unit as shown in FIG. 1, the unseparated body signifies on its face that the holder has both rights in the stock. When the body is detached as shown in FIG. 3, the separated first portion 2 signifies on its face that the holder has only the SCORE (capital) right in the stock and the separated second portion 3 signifies on its face that the holder has only the PRIME (income) right in the stock.

While preferred embodiments of the invention have been shown by way of example in the drawings, it will be understood that the invention is in no way limited to these embodiments.

What is claimed is:

1. Stock certificate comprising a planar body having indicia thereon denoting the body as a single stock certificate and comprising a first portion corresponding to a first type of interest in the stock having indicia thereon denoting the first type of interest and a second portion corresponding to a second type of interest in the stock having indicia thereon denoting the second type of interest and means for effecting bipartition of the body into separated first portion to signify on its face that the holder has only the first interest in the stock, the separated second portion to signify on its face that the holder has only the second interest in the stock and the unseparated body to signify on its face that the holder has both the first and second interests in the stock.

2. Stock certificate of claim 1 wherein the two body portions are integral with each other and the means for effecting bipartition comprises a line of perforations between the two portions.

3. Stock certificate of claim 2 wherein the body is substantially rectangular in shape and comprises paper and wherein the line bisects the body into two rectangular portions.

4. Stock certificate of claim 3 further comprising a seal superposed over a portion of the line.

5. Stock certificate of claim 1 wherein the two body portions are integral with each other and the means for effecting bipartition comprises an indented line between the two portions.

6. Stock certificate of claim 5 wherein the body is substantally rectangular in shape and comprises paper and wherein the line bisects the body into two rectangular portions.

7. Stock certificate of claim 6 further comprising a seal superposed over a portion of the line.

8. Stock certificate of claim 1 wherein the two body portions are integral with each other and the means for effecting bipartition comprises a line between the two portions along which the body can be cut.

9. Stock certificate of claim 8 wherein the body is substantially rectangular in shape and comprises paper and wherein the line bisects the body into two rectangular portions.

10. Stock certificate of claim 9 further comprising a seal superposed over a portion of the line.

* * * * *